United States Patent [19]

Rossi

[11] 3,945,624

[45] Mar. 23, 1976

[54] REDUCTION KILN HAVING A CONTROLLABLE DISTRIBUTION SYSTEM

[75] Inventor: Eugene F. Rossi, Wauwatosa, Wis.

[73] Assignee: Allis-Chalmers Corporation, Milwaukee, Wis.

[22] Filed: Sept. 13, 1973

[21] Appl. No.: 397,081

Related U.S. Application Data

[63] Continuation of Ser. No. 302,605, Oct. 31, 1972, abandoned.

[52] U.S. Cl. ..... 266/20

[51] Int. Cl.[2] ..... F27B 7/20; F27B 7/36

[58] Field of Search ..... 75/34, 91; 266/20, 24; 432/14, 17, 109, 117, 51, 52, 53

[56] References Cited

UNITED STATES PATENTS

| | | | |
|---|---|---|---|
| 1,121,906 | 12/1914 | Downs | 432/109 |
| 1,216,667 | 2/1917 | Downs | 432/109 |
| 2,091,850 | 8/1937 | Göhre | 432/109 |
| 3,068,091 | 12/1962 | Kirkland | 266/24 X |
| 3,170,786 | 2/1965 | Moklebust | 432/109 |
| 3,171,638 | 3/1965 | Zimmerley et al. | 266/20 X |
| 3,580,554 | 5/1971 | Bushuev et al. | 432/109 X |
| 3,584,849 | 6/1971 | Cremer et al. | 432/51 X |
| 3,831,913 | 8/1924 | Ando et al. | 266/24 |

FOREIGN PATENTS OR APPLICATIONS

| | | | |
|---|---|---|---|
| 639,900 | 12/1936 | Germany | 75/34 |
| 643,251 | 4/1937 | Germany | 432/51 |

*Primary Examiner*—Roy Lake
*Assistant Examiner*—Paul A. Bell
*Attorney, Agent, or Firm*—John P. Hines

[57] ABSTRACT

A process and apparatus are disclosed for delivering fuel and air to a rotary reduction kiln wherein both the fuel and air alternately flow through the same fluid distribution nozzle. Means are provided about the kiln for operating means to alternately deliver of fuel or air through the same nozzle. At least one of the operating means is selectively movable into and out of the position of operating said valve.

1 Claim, 5 Drawing Figures

REDUCTION KILN HAVING A CONTROLLABLE DISTRIBUTION SYSTEM

This is a continuation, of application Ser. No. 302,605, filed Oct. 31, 1972 and now abandoned.

This invention relates to rotary kilns used for such purposes as reducing iron ore to a lower state of oxidation having nozzles mounted on the outer surface of the kiln projecting radially through the kiln shell and including central means adapted to alternately inject both air and fuel into the kiln through the same nozzles. In particular the invention relates to such a rotary kiln wherein the control means is capable of admitting only air through all nozzles while the kiln is being preheated.

In the prior art rotary kilns are known wherein a plurality of nozzles are provided through the shell of the kiln to admit air and fuel into the interior or ore reduction chamber of the kiln. A charge of ore is provided in the reduction chamber and it is reduced to a higher state of iron.

Examples of such prior art kilns are disclosed in U.S. Pat. No. 1,216,667 issued Feb. 20, 1971, U.S. Pat. No. 2,091,850 issued Aug. 31, 1937 and U.S. Pat. No. 3,182,980 issued May 11, 1965.

In the prior art kilns fuel and air are delivered through the nozzles by piping supported on the exterior of the kiln or on the interior of the kiln. This piping is connected to the nozzles for injecting the fuel and air into the reduction chamber. In the prior art a mixture of both fuel and air has been admitted through the nozzles at the same time or fuel is admitted through one nozzle and air admitted through a different nozzle.

In certain instances it is desirable to admit only one fluid through a nozzle when it is beneath the charge and only the other fluid when the nozzle is above the charge. As an example it is desirable in certain instances to admit fuel to the reduction chamber through nozzles as they pass directly beneath the bed of the charge whereby the fuel flows directly into the charge. When this nozzle has moved beyond the bed of the charge the fuel is shut off and no fluid is passing through the nozzle. At the same time air is admitted to the reduction chamber above the charge through additional nozzles. Before these air nozzles pass beneath the bed the air is turned off so that no fluid passes through these nozzles as they pass beneath the bed. Furthermore, it is advisable to admit only air through the air nozzles while the kiln is being preheated.

From the above it can be seen that quite a large number of nozzles are required. It is not unusual to have as many as 300 nozzles in a rotary of a 150 foot size. Furthermore these nozzles are exposed to extremely high temperatures in the range of 2,000° Fahrenheit. While the fluid is flowing through a nozzle the fluid itself has a tendency to cool the nozzle. However, when no fluid is passing through the nozzle it approaches the temperature within the reduction chamber thereby reducing the effective life of the nozzle.

It is therefore, the intention and general object of this invention to provide a process for reducing ore and apparatus for practicing the process wherein the number of nozzles required is reduced by one-half and the temperature of the nozzles is reduced by admitting fluid through the nozzles during a substantially part of the kiln rotation.

An additional object of this invention is to provide a process wherein both fuel and air are admitted through the same nozzles at different points of rotation of the kiln and only air is admitted through all nozzles while the kiln is being preheated.

An additional object of the subject invention is to provide a rotary kiln with fluid distribution means which alternately delivers fuel or air to each nozzle at preselected points of rotation of the nozzle relative to the kiln charge and air only to all of the nozzles while the kiln is being preheated.

A more specific object of the subject invention is to provide a rotary ore reducing kiln of the hereinbefore described type wherein valve means connect both the fuel and air to a single nozzle for selective alternate flow of both fluids through the same nozzle or only one fluid through all nozzles.

An additional object of the subject invention is to provide a kiln of the hereinbefore described type wherein a single valve is utilized to alternately direct either fuel or air through the same nozzle at selected points of rotation of the kiln and alternately only air through all nozzles during full rotation of the kiln while the kiln is being preheated.

These and other objects of the subject invention will become more fully apparent as the following desription is read in light of the attached drawings wherein.

Figure 2:
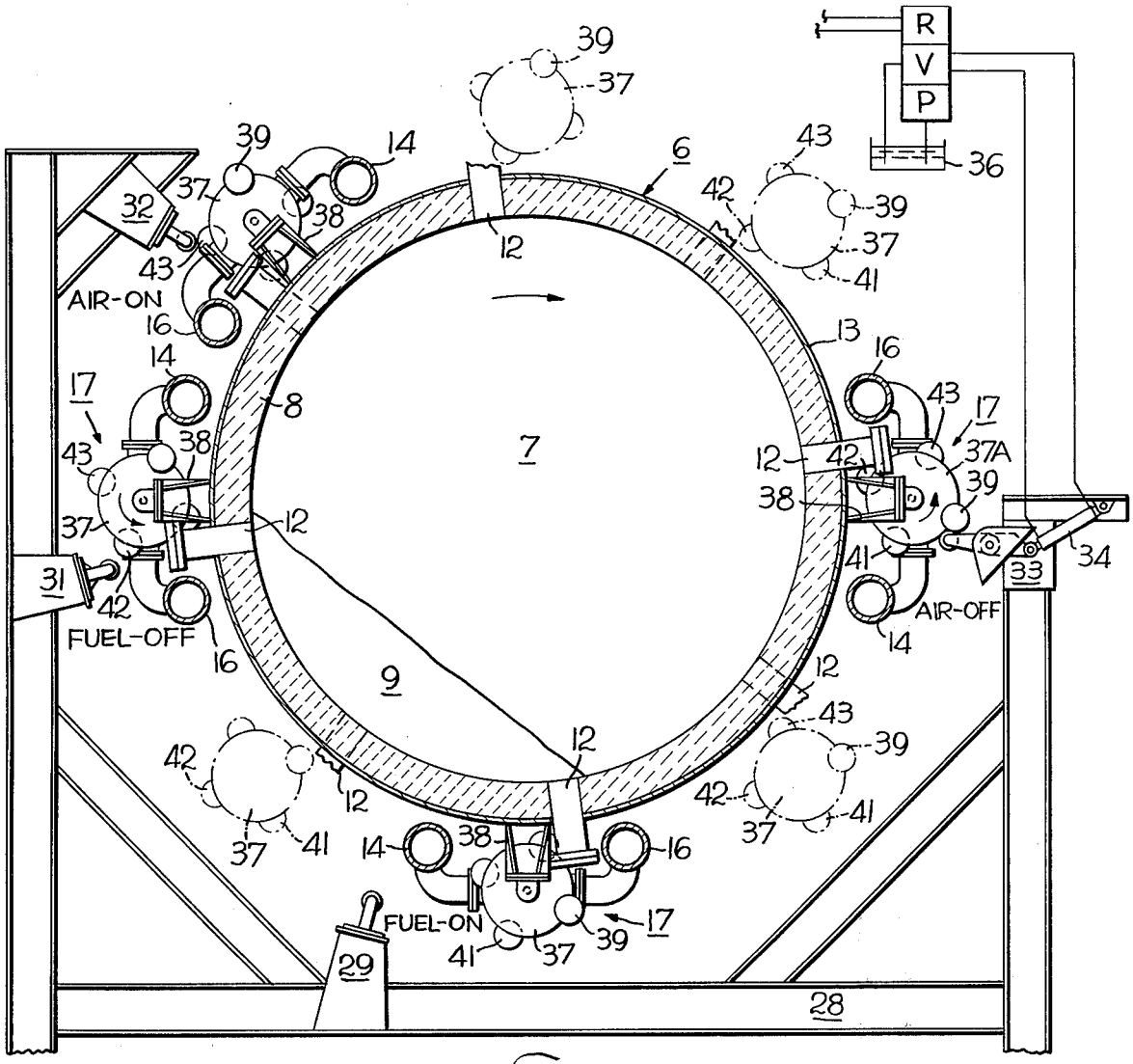
FIG. 2 is a section taken along the lines II—II of FIG. 1 and additionally showing means for operating the fluid distribution means.

Referring to the attached drawing the kiln shown herein for purposes of illustration is provided with an elongated cylindrical body portion 6 which defines a cylindrical reduction or combustion chamber 7. The shell or inner wall 8 of the kiln may be constructed of any suitable refractory material such as firebricks. Any well-known means may be provided for supporting and rotating the kiln. Since such means form no part of this invention and are well known in the art they are not shown herein. A charge of ore generally designated 9 is shown in FIG. 2. A main burner 11 is provided at the right-hand end of the kiln to preheat the kiln.

A plurality of circumferentially and axially spaced nozzles 12 are provided about the surface of the kiln opening into the chamber 7. These nozzles may be contructed of any conventional manner and are preferably constructed in accordance with my co-pending application entitled "Nozzle For Rotary Kiln." The nozzles may be supported by the outer kiln plate 13 as is shown in the said co-pending application. A plurality of circumferentially spaced fuel and air conduits 14 and 16 respectively are also supported about the surface of the kiln. Any conventional means in the form of a manifold (not shown) may be provided to deliver fuel and air to the conduits 14 and 16 respectively. A fluid distribution means generally designated 17 connects the respective fuel and air conduits to the associated nozzles. This fluid distribution means may comprise a plurality of valves or as shown herein for purposes of illustration may comprise a single three-way valve generally designated 18 and fluid transfer conduit means 19 connecting the outlet of the valve 18 to the associated nozzles 12.

Figure 1:
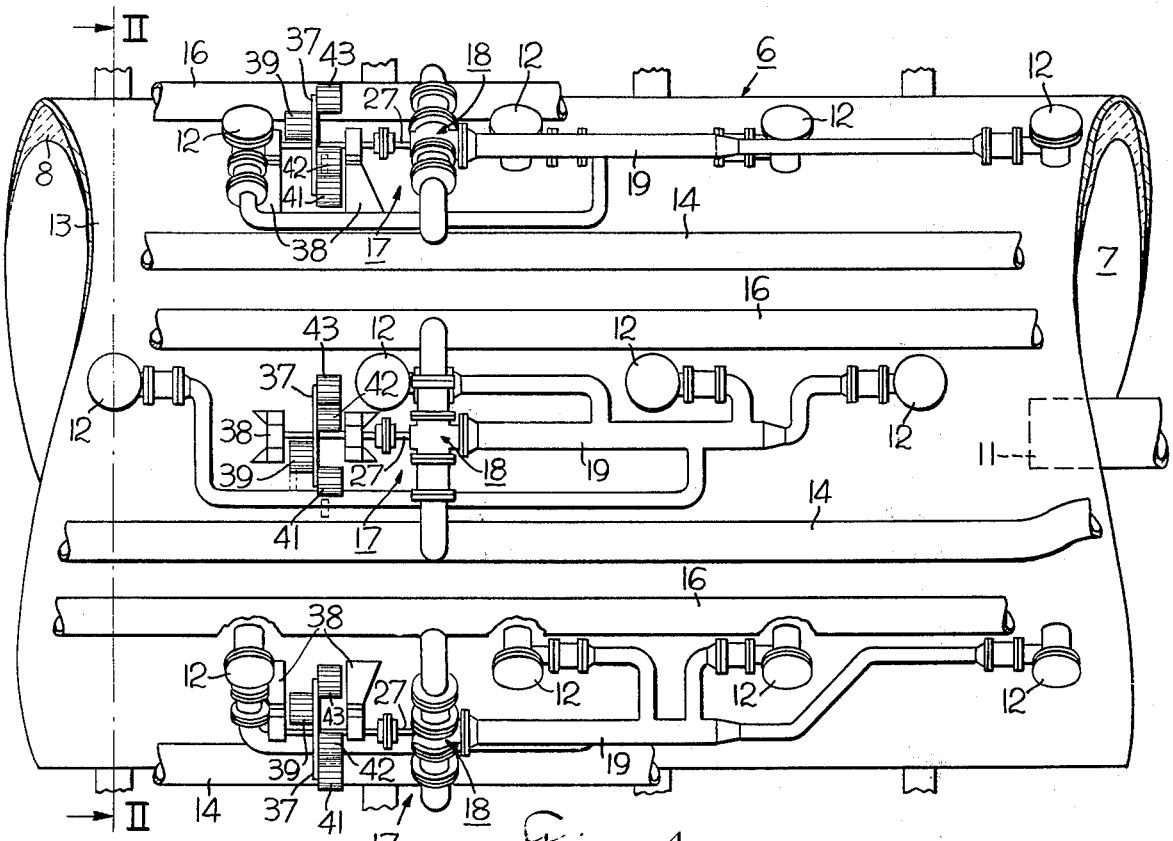
FIG. 1 is a side elevation of a portion of a kiln constructed in accordance with the invention.
Figure 3:
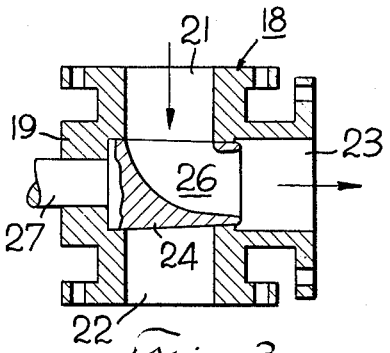
FIG. 3 is a cross-section of a particular type of valve showing one inlet port connected to the outlet port.
Figure 4:
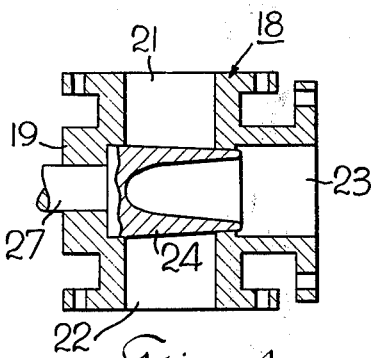
FIG. 4 shows the same valve as FIG. 3 with both inlet ports shut off.
Figure 5:
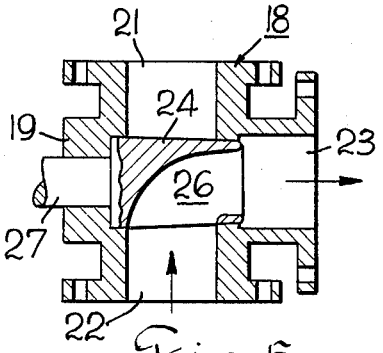
FIG. 5 shows the same valve with the other inlet port connected to the outlet port.

The particular valve 18 shown herein for purposes of illustration is more clearly defined in FIGS. 3 through 5. The valve consists of a valve body 19 having two opposed inlet ports 21 and 22 and a single outlet port 23. A rotary plug 24 having a passageway 26, in the configuration shown, is rotatably supported in the valve body and has a valve stem 27 attached thereto and extending to the exterior of the valve body.

Prior to commencing the reduction process and the admission of the fuel it is necessary to preheat the kiln to operating temperature. This is accomplished by rotating the kiln as the burner 11 heats the chamber 7. It is advantageous to admit air only through all nozzles 12 as the kiln is being preheated to operating temperature. This not only assists the combustion of the main burner 11 but tends to cool the nozzles because of the flow of air therethrough. Furthermore, after the kiln is preheated in many instances it is desirable to admit fuel from conduit 14 only through those nozzles that are beneath the ore charge and air from conduit 16 only through those nozzles that are above the charge 9. To this end means are provided to operate the valve 18 to effect this alternate delivery of fuel and air through each of the nozzles and air only through all nozzles.

A preferred relatively inexpensive mechanical operating mechanism for controlling the flow of fuel and air into the chamber 7 is shown most clearly in FIG. 2. It should be understood that while this control mechanism is perfectly acceptable other means for operating the fluid distribution means 17 could be employed such as solenoid valves and hydraulic or air actuators. Referring to FIG. 2 a frame generally designated 28 is provided about the kiln 6.

This frame 28 is provided with four strategically located trip means 29, 31, 32, and 33. One of these trip means 33 is adjustable to permit movement of the trip means into a nonengaging position. Such adjusting means are herein shown in the form of a hydraulic servomotor 34 which is operated by a control valve V which in turn is activated by an electrical relay R controlled from a remote source. A pump P is provided to pressurize the fluid from the sump 36. The operation of this adjustable trip 33 will be apparent as the description continues.

Each valve shaft 27 is connected to a cam plate 37 which is supported for rotation on brackets 38 connected to the exterior of the kiln for rotation therewith. Each cam plate 37 has four cams 39, 41, 42 and 43 supported about the periphery thereof. The cams are spaced substantialy 90 degrees from one another and are located to engage a particular trip means when they are in a radially outward position relative to the axis of the kiln. It should be noted that in this particular arrangement one cam 39 is located on the opposite side of the plates 37 relative to the other cams 41, 42 and 43. This cam 39 is in the plane of the adjustable trip 33 whereas the other cams are in the plane of the trips 29, 31 and 32.

The operation of the apparatus will now be described. In order to assist in understanding the operation the trip means are identified on the drawings starting with the adjustable trip 33 as air-off - fuel-on - fuel-off and air-on. The external valves (not shown) for the air and fuel are turned on so that air is in the conduits 16 and fuel is in the conduits 14. The relay R is activated to cause the servomotor 34 to move the trip 33 to a nonengaging position so that the cam 39 will not contact the trip as it rotates.

As a starting point assume that the cam 41 is about to contact the fuel-on trip 29. This causes the valve 18 to move to the position shown in FIG. 5 connecting the fuel conduits 14 to the associated nozzles admitting fuel to the interior of the kiln. After cam 41 contacts trip 29 it indexes the cam plate 37 so that cam 42 is now in a trip contacting position. As the kiln continues to rotate the cam 42 will contact the trip 31 and the valve 18 will be in the off position shown in FIG. 4 thereby shutting off the flow of fuel to the kiln. As the kiln continues to rotate the cam 43, now indexed to the trip engaging position, will contact the trip 32 and the valve will be moved to the position shown in FIG. 3 permitting air to pass from the conduits 16 through the connected nozzles 12. At this point the air off cam 39 is indexed to the trip engaging position whereas all other cams are in a nonengaging position. Therefore, since the air-off cam 39 is in a different plane from the trips 29, 31 and 32 and the trip 33 has been removed from a position of engagement with the cam 39 no cam will engage any trip to index the cam plate 37 and air only will continue to flow through the nozzles as the kiln continues to rotate. Since only the air-off cam is in a trip engaging position and the air-off trip is moved out of the cam engaging position, air will continue to enter the kiln through all nozzles and the fuel will be effectively shut off from the kiln. At this point the main burner 11 is ignited and the kiln is preheated.

After the kiln has warmed up to operating temperature the relay R is de-energized causing the valve V to direct fluid to the servomotor 34 and reposition the trip 33 into an engaging position with the cam 39 as shown in the drawing. As the kiln continues to rotate cam 39 of cam plate 37A will engage trip 33 causing the valve 18 to rotate to the off position shown in FIG. 4. No fuel or air will flow through the nozzles controlled by the cam plate 37A until it approaches trip 29 where cam 41, which has been indexed to trip engaging position, will contact trip 29 and admit fuel through the associated nozzles. After the cams on all cam plates sequentially engage each of the trips the charge of ore 9 is introduced into the kiln. This process of alternate admission of air and fuel through the nozzles will repeat as the kiln rotates.

From the above it can be seen that both fuel and air are alternately admitted through each of the nozzles 12 and air only is admitted through all nozzles while the kiln is being preheated. This results in a reduction in the number of nozzles required by one-half over those kilns which have a separate nozzle for fuel and a separate nozzle for air. Furthermore, because fuel or air is flowing through each nozzle during most of the time the process is being carried on, the nozzle temperature is reduced due to the relatively cooler fuel or air passing through the pipes on the exterior of the kiln. It should be understood that the control mechanism could be so arranged that the air flowing through the nozzle is only turned off as the fuel is turned on thereby having no period of time that a fluid is not flowing through the nozzles.

The embodiments of the invention in which an exclusive property or privilege is claimed are defined as follows:

1. A rotary ore reducing kiln comprising an elongated cylindrical chamber having a charge to be reduced contained therein; a nozzle supported by said kiln in fluid communication with said chamber, said nozzle rotating with said kiln and alternately passing beneath and above said charge; first and second fuel and air conduit means supported on the exterior of said kiln; valve means associated with said nozzle and said conduit means operable to selectively and alternately connect said first and second conduit means to said nozzle; a cam plate supported on said kiln and having at least first and second cams located in axially spaced planes operatively connected to said valve means for selective operation thereof; at least first and second trip means supported in axially spaced planes about said kiln for selective engagement by said first and second cams respectively as said kiln rotates, said cams and said trip means being arranged to operate said valve means to selectively and alternately connect said first and second conduits to said nozzle, said cams and said trip means being arranged whereby each cam must sequently engage its associated trip to index the other cam to engage its associated trip; and means connected to one of said trip means operable to selectively move said one trip means into and out of position for engagement by its associated cam whereby said valve may be positioned to continuously connect one of said conduit means to said nozzle.

* * * * *